US006942449B2

(12) United States Patent
Boyer

(10) Patent No.: US 6,942,449 B2
(45) Date of Patent: Sep. 13, 2005

(54) TRAILING EDGE COOLING

(75) Inventor: Jason W. Boyer, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/340,971

(22) Filed: Jan. 13, 2003

(65) Prior Publication Data

US 2004/0136824 A1 Jul. 15, 2004

(51) Int. Cl.[7] ..... F04D 29/38
(52) U.S. Cl. ..... 415/115; 416/96 R; 416/96 A
(58) Field of Search ..... 415/115, 116; 416/97 R, 96 R, 96 A; 29/889.721, 889.72

(56) References Cited

U.S. PATENT DOCUMENTS 3,420,502 A 1/1969 Howald
5,120,192 A * 6/1992 Ohtomo et al. ..... 415/115
5,243,759 A 9/1993 Brown et al.
5,503,529 A 4/1996 Anselmi et al.
5,827,043 A * 10/1998 Fukuda et al. ..... 415/115
2002/0197161 A1 12/2002 Miller et al.

FOREIGN PATENT DOCUMENTS

EP 0 034 961 9/1981

* cited by examiner

*Primary Examiner*—Edward K. Look
*Assistant Examiner*—Dwayne J. White
(74) *Attorney, Agent, or Firm*—Bachman & LaPointe, P.C.

(57) ABSTRACT

An airfoil has first and second ends, leading and trailing edges, and an internal cooling passageway network. A plurality of trailing edge holes extend from the trailing edge to a trailing edge cavity of the network. The trailing edge holes are arrayed at a spacing which progressively changes from the first end toward the second end.

20 Claims, 5 Drawing Sheets

TRAILING EDGE COOLING

U.S. GOVERNMENT RIGHTS

The invention was made with U.S. Government support under contract F33657-94-d-2001 awarded by the U.S. Air Force. The U.S. Government has certain rights in the invention.

BACKGROUND OF THE INVENTION (1) Field of the Invention

This invention relates to turbomachinery, and more particularly to cooled turbine blades and vanes.

(2) Description of the Related Art

Trailing edge cooling is a common feature of turbine blades and vanes. In one common method of manufacture, the main passageways of a cooling network within the blade/vane airfoil are formed utilizing a sacrificial core during the blade/vane casting process. The airfoil surface may be provided with holes communicating with the network. Some or all of these holes may be drilled. In one method of manufacture, an array of trailing edge holes may be drilled parallel to each other and at an even pitch.

BRIEF SUMMARY OF THE INVENTION

Accordingly one aspect of the invention involves an airfoil having first and second ends, leading and trailing edges, and an internal cooling passageway network. A plurality of trailing edge holes extend from the trailing edge to a trailing edge cavity of the network. The trailing edge holes are arrayed at a spacing which progressively changes from the first end toward the second end. The network may be adapted to direct cooling gas within the trailing edge cavity to increase in temperature in a first direction parallel to the trailing edge. The spacing may substantially progressively decrease in that first direction. The trailing edge cavity may be an impingement cavity. Other aspects of the invention relate to methods of manufacture of a turbine element.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
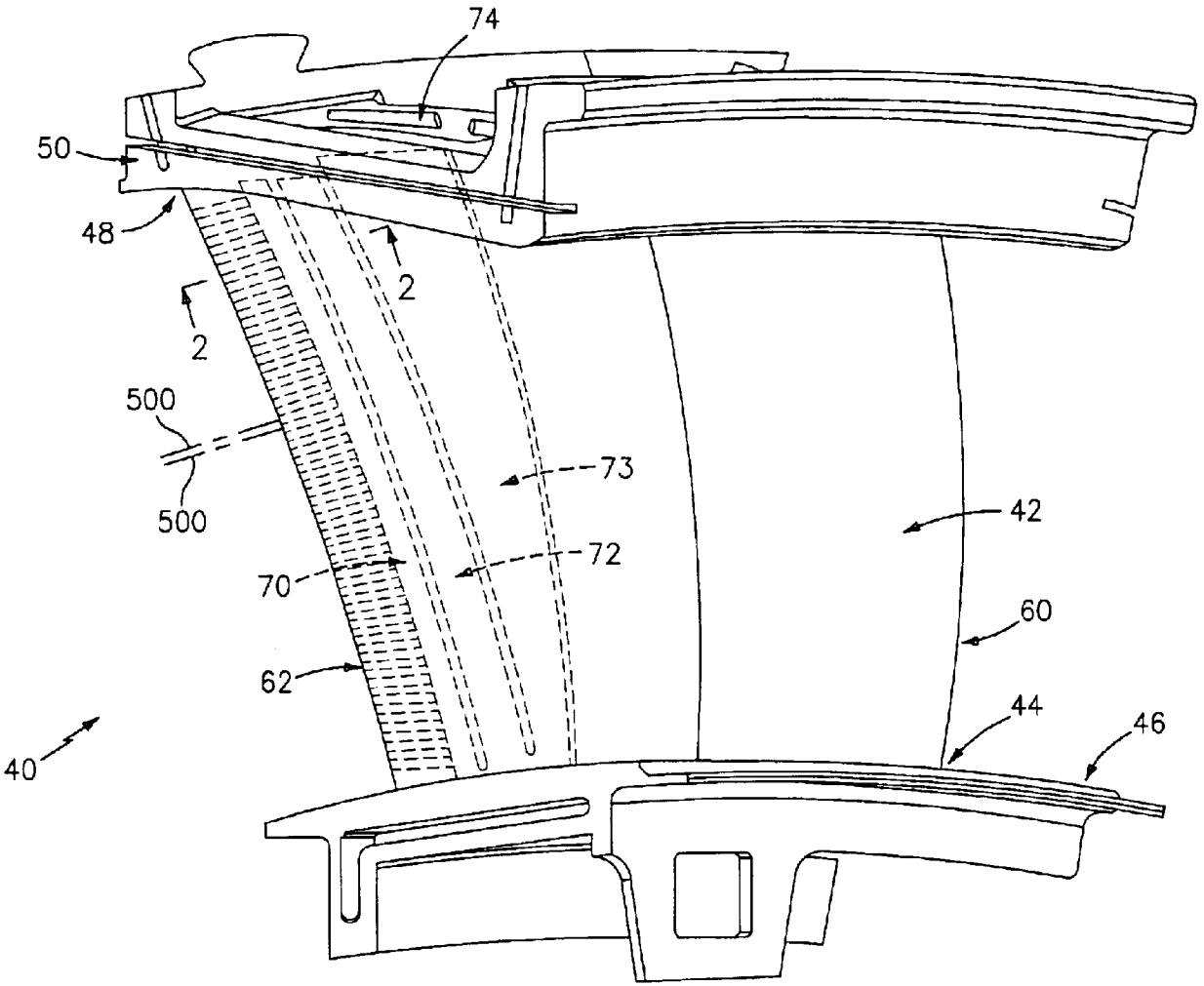
FIG. 1 is a view of a turbine vane.

FIG. 1 shows a turbine blade 40 having an airfoil 42 extending along a length from a proximal root 44 at an inboard platform 46 to a distal end 48 at an outboard platform 50. A number of such vanes may be assembly side-by-side with their respective inboard and outboard platforms forming inboard and outboard rings bounding inboard and outboard portions of a flow path. In an exemplary embodiment, the vane is unitarily formed of a metal alloy.

Figure 2:
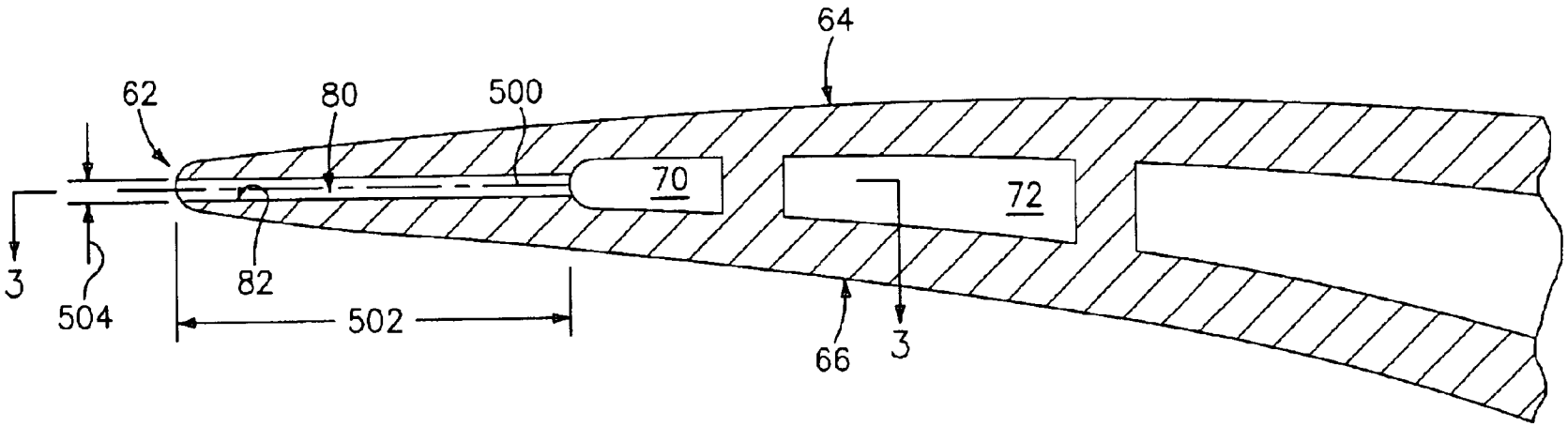
FIG. 2 is a partial sectional view of the vane of FIG. 1, taken along line 2—2.

The airfoil extends from a leading edge 60 to a trailing edge 62. The leading and trailing edges separate pressure and suction sides or surfaces 64 and 66 (FIG. 2). For cooling the airfoil, the airfoil is provided with a cooling passageway network coupled to ports in one or both platforms. The exemplary passageway network includes a series of cavities extending generally lengthwise along the airfoil. An aftmost cavity is identified as a trailing edge cavity 70 extending generally parallel to the trailing edge. A penultimate cavity 72 is located ahead of the trailing edge cavity 70. The cavities may be joined at one or both ends and/or locations along their lengths so as to permit flows from the penultimate cavity to the trailing edge cavity. In the illustrated embodiment, the cavities 70 and 72 are impingement cavities. The penultimate cavity 72 receives air from a supply cavity 73 through an array of apertures 75 (FIG. 3) in the wall separating the two. The supply cavity 73 receives air from a port 74 in the platform 50. Likewise, the trailing edge cavity 70 receives air from the penultimate cavity 72 via apertures 77 in the wall between the two. To the extent that the cooling air in the supply cavity 73 is heated as it progresses radially inward, the cooling air temperatures in the impingement cavities 70 and 72 will similarly increase in the radially inward direction.

The network may further include holes extending to the pressure and suction surfaces 64 and 66 for further cooling and insulating the surfaces from high external temperatures. Among these holes may be an array of trailing edge holes 80 extending between a location proximate the trailing edge and an aft extremity of the trailing edge impingement cavity 70. FIG. 2 shows one such hole having a surface 82 centered about an axis 500 and extending along a length 502. The exemplary hole has a circular section with a diameter 504.

Figure 3:
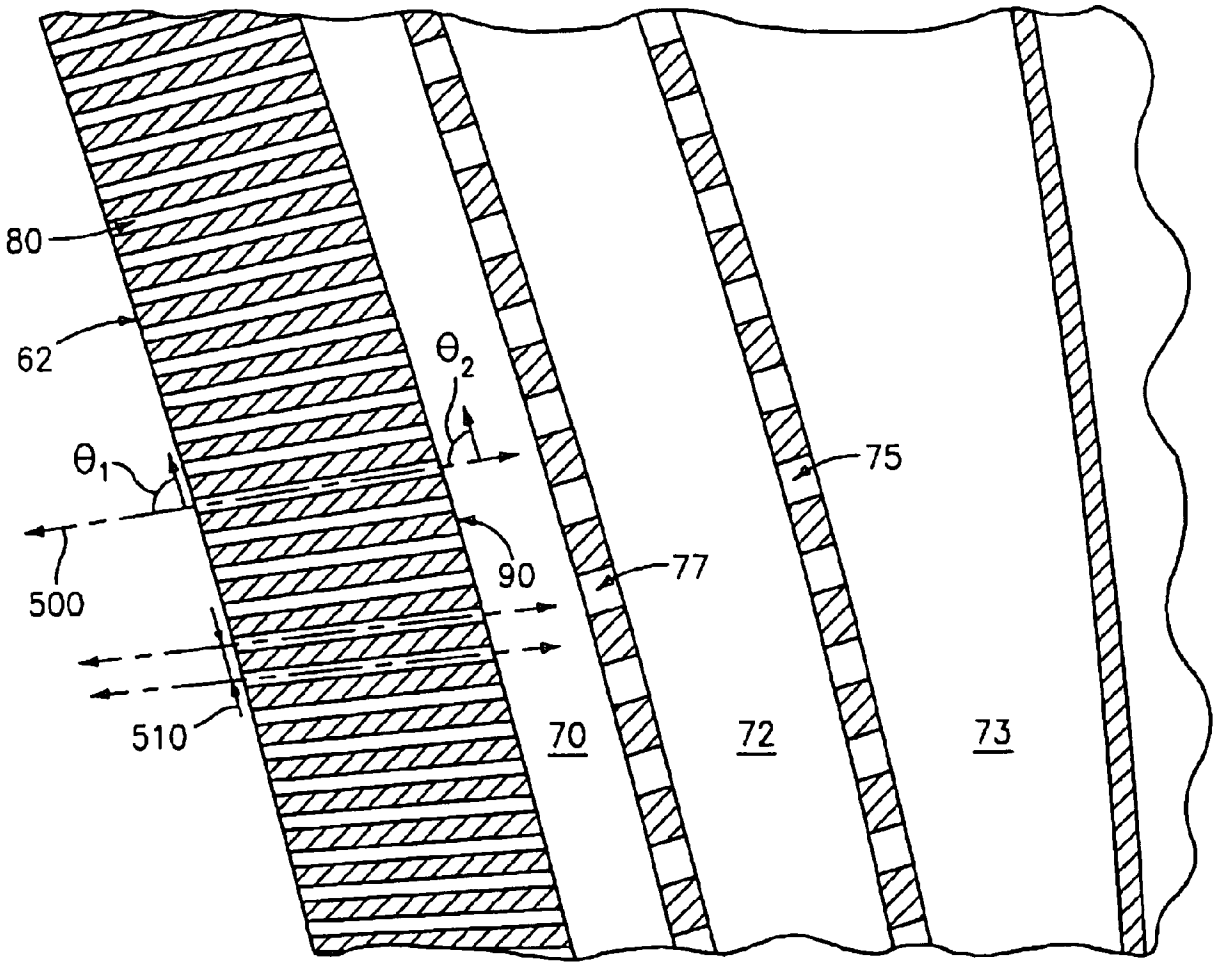
FIG. 3 is a view of the vane of FIG. 2, taken along line 3—3.

FIG. 3 shows a portion of the array of trailing edge holes 80. The holes, or more precisely their axes 500, are shown as at an angle $\theta_1$ relative to the trailing edge and at an angle $\theta_2$ relative to the local aft extremity 90 of the trailing edge impingement cavity 70. To the extent that the trailing edge 62 and aft extremity 90 are parallel, the illustrated angles $\theta_1$ and $\theta_2$ will be identical to each other for a given hole 80. A pitch 510 of the holes is measured as the hole centerline spacing along the trailing edge.

As is explored in further detail below, the axes 500 of every hole 80 need not be parallel to each other. Similarly, the angles $\theta_1$ and/or $\theta_2$ of each hole 80 need not be the same, nor need be their diameters 504 and lengths 502. Structural integrity and manufacturing considerations may influence or dictate the separation of the trailing edge 62 from the aft extremity 90 of the cavity 70. It is advantageous that the holes 80 be short and narrow so as to maximize possible cooling close to the trailing edge. The narrowness (e.g., the diameter) is largely limited by ease of drilling. Subject to additional manufacturing and terminal considerations (discussed below) this minimization would be achieved by having the axes 500 as close as possible to mutually perpendicular to the trailing edge 62 and aft extremity 90.

Along the trailing edge, less cooling may be required per linear dimension along one portion of the trailing edge than along another. In the exemplary embodiment, with cooling air flowing generally radially inward in the supply cavity 73, the air passing through the impingement cavities 72 and 70 and through the holes 80 may be cooler near the end 48 than near the root 44 due to the shorter net flow path. As this cooler air is more effective for heat transfer, less volume of air per linear dimension need be passed through the holes 80 near the end 48 than near the root 44. Accordingly, to efficiently utilize the cooling air passing through the cavity

70, it may be advantageous that the hole spacing generally increase in an outboard direction along the trailing edge. Ignoring manufacturing considerations and terminal considerations, the change in spacing could well be continuous, with a slight change in spacing from each hole to the next in accordance with an appropriate cooling distribution.

Figure 4:
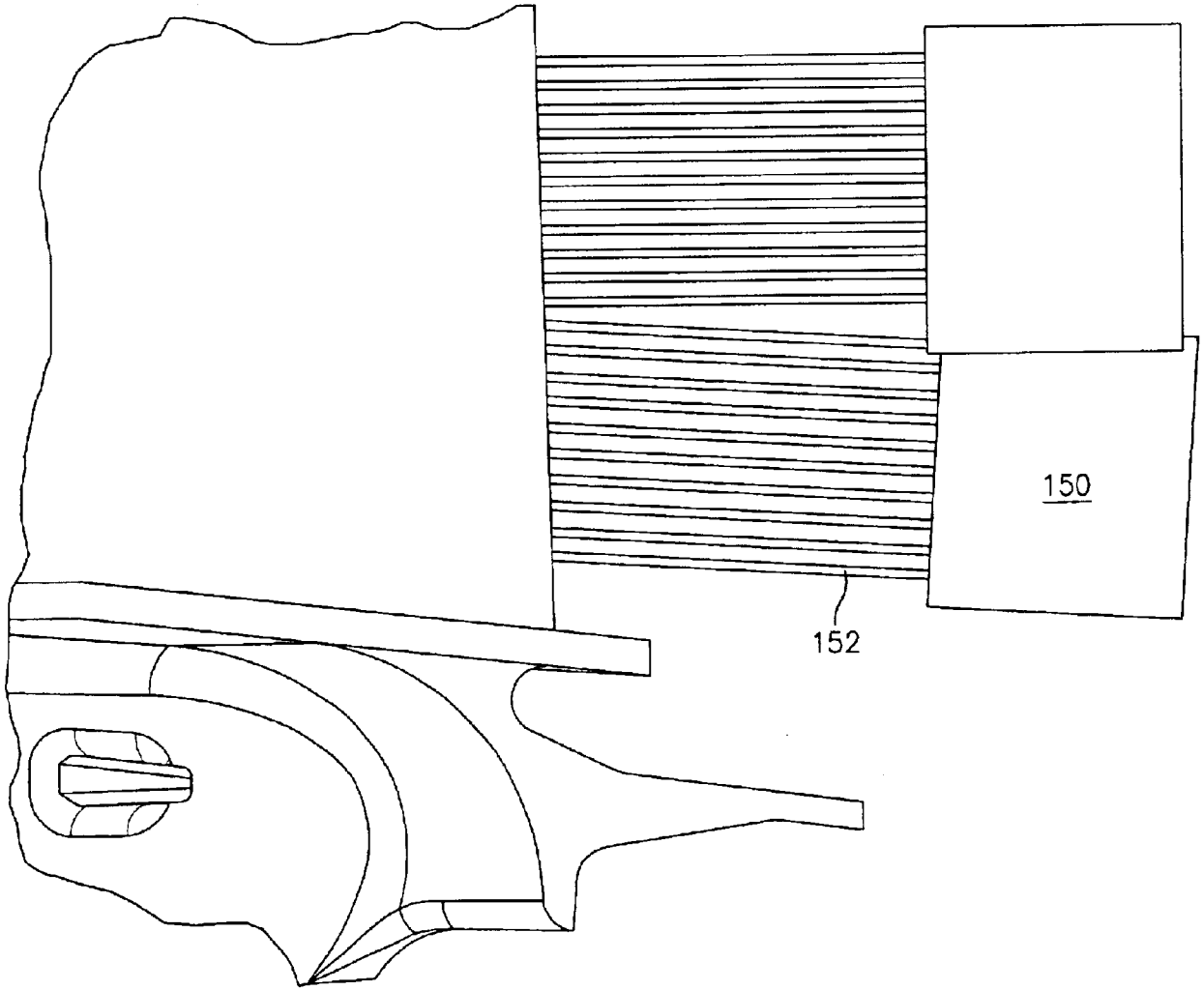
FIG. 4 is a view of a vane/blade manufacturing apparatus.

If, for example, the terminal end of the cavity 70 did not extend as far as the outboard end of the trailing edge, it might be desirable to slightly fan the holes near the outboard edge or otherwise enhance cooling. The inboard end of the trailing edge may also pose manufacturability problems due to interference with a drilling apparatus. If it is desired to drill the holes perpendicular to the trailing edge, the inboard platform may interfere with drilling of the inboardmost hole or holes along the trailing edge, thus, for a given drilling apparatus, a restriction to perpendicular holes might place the inboardmost hole to far outboard. Accordingly, for this hole such considerations may cause a reduction in the angle $\theta_1$ below 90° so as to permit the hole to be sufficiently inboard. Also, access to the trailing cavity at inboard or outboard ends of the trailing edge may alter the angle $\theta_1$ from that which might otherwise be desirable. Additionally, it may be desired to gang drill several holes at a time with a single drilling apparatus 150 (FIG. 4) having several bits 152 (10 bits shown). The use of such apparatus may restrict freedom in the spacing selection and in the hole orientation. One such apparatus might require the several gang-drilled holes to be parallel to each other, preventing independent selection of the angle $\theta_1$ for each hole. Ease of constructing such apparatus might require that the several hole axes be evenly spaced from each other, thereby preventing independent selection of spacing for each hole. Alternatively, however, the spacing could change along a given apparatus with a characteristic spacing (e.g., a mean or median) of one apparatus differing from that of the next. With such apparatus, a continuous change in spacing may be achieved.

With this in mind, in one gang-drilling example, a single drilling apparatus is utilized to drill a given number N (e.g., 5–15) of holes at a time. The apparatus may be used to drill a number M (e.g., 5 or more) of sets of such N holes with an exemplary total number of holes being between 40 and 200. The axes of each set could be nonparallel to the axes of the other sets, thus permitting the sets of holes to be relatively close to perpendicular to the trailing edge (again subject to departures due to terminal considerations). In another example, different drilling apparatus 150 having different axis spacing may be utilized to drill the different sets of holes.

By way of example, the radial span of the trailing edge may be about 1.0–15 inches depending on the application. The hole diameters may be between about 0.01 inch and 0.15, more narrowly about 0.015–0.025. The hole length may be between 5–25 times the hole diameter. In an exemplary vane embodiment, the vane is dimensioned so that the, when the ring is assembled, the root at the trailing edge is at a radius of about ten inches relative to the engine centerline. The outboard end of the trailing edge is at a radius of about 12.5 inches. In the exemplary embodiment, the spacing starts at approximately 2.1 times the hole diameter near the inboard platform, remains generally the same until the middle of the length of the trailing edge and then increases to approximately 2.7 times the diameter toward the outboard platform. Thus one drilling apparatus with the smaller spacing may drill several groups of holes and then a second apparatus having the larger spacing may drill the remainder (which in the exemplary embodiment is a slightly smaller number of holes). In the exemplary embodiment, the hole length varies from approximately 14.5 times the hole diameter near the inboard platform to approximately 13.75 times the hole diameter near the outboard platform. In the exemplary embodiment, along about the inboardmost 10% of the trailing edge, the holes near the inboard platform are at a spacing larger than the 2.1 figure due to a reduced cooling need near the platform. Thus it can be seen that the progressive spacing may be over only a substantial portion of the trailing edge (e.g., 40–90% or, more narrowly, 50–80%).

Figure 5:
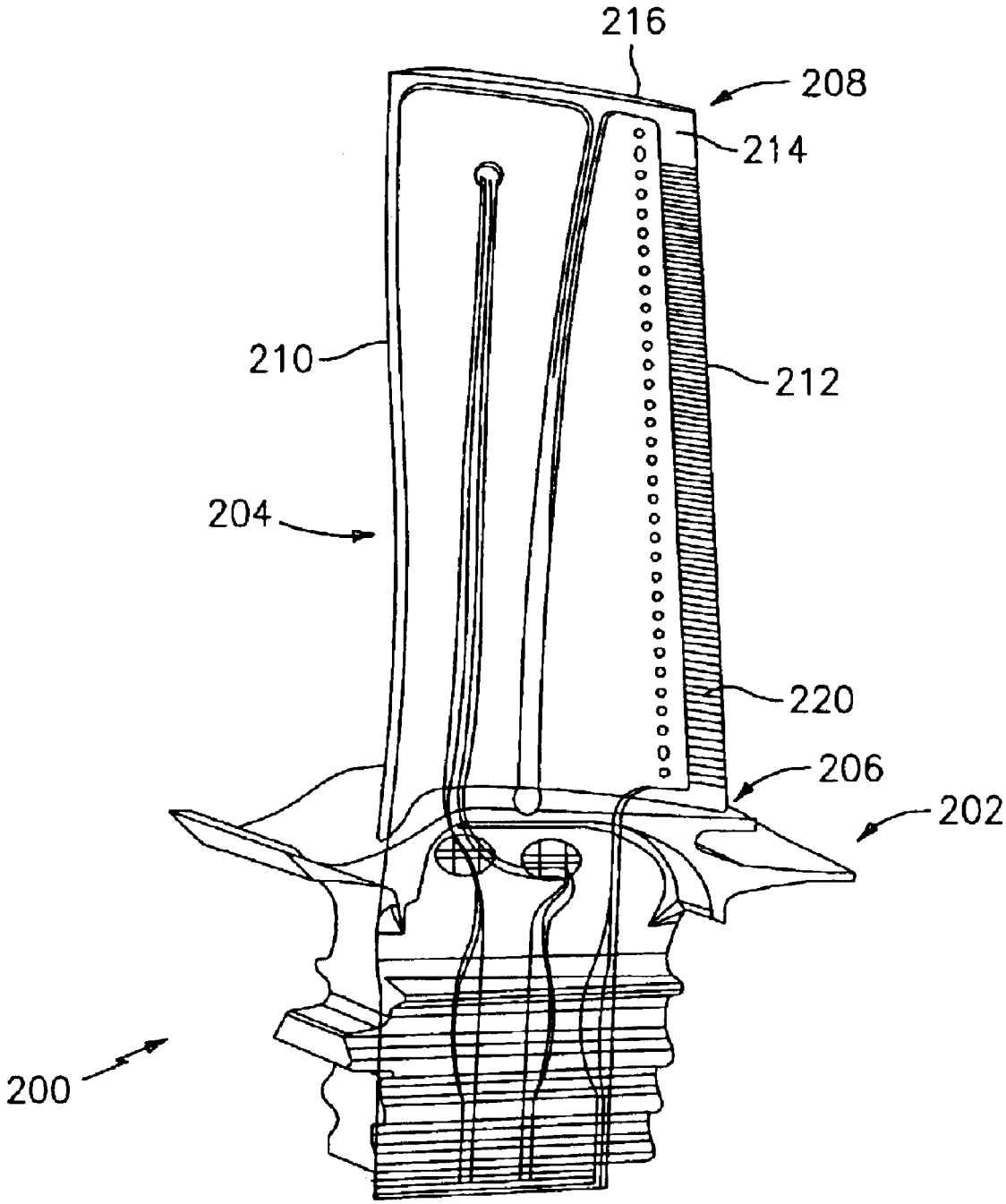
FIG. 5 is an x-ray view of a turbine blade.

FIG. 5 shows a turbine blade 200 having a platform 202 and an airfoil 204 extending from a proximal root 206 at the platform to a distal end tip 208. The airfoil may have substantial similarities to the vane airfoil. In given turbine, and a number of such blades may be positioned with their platforms side-by-side to form a ring. Such blade rings may be interspersed with the vane rings, the inboard platforms of both forming a generally continuous inboard wall of the flow path through the turbine. The exemplary blade airfoil has leading and trailing edges 210 and 212 separating pressure and suction sides 214 and 216. The blade airfoil may have an array of trailing edge holes 220 similar to that of the vane airfoil.

One or more embodiments of the present invention have been described. Nevertheless, it will be understood that various modifications may be made without departing from the spirit and scope of the invention. For example, desired flow characteristics of the turbine may influence hole arrangement in view of available manufacturing techniques. This is particularly true in redesign or retrofit of existing turbines. Accordingly, other embodiments are within the scope of the following claims.

What is claimed is:

1. A turbine element comprising:

a platform; and an airfoil:

extending along a length from a proximal root at the platform to a distal end;

having leading and trailing edges separating pressure and suction sides; and having a cooling passageway network including at least one trailing edge cavity and means extending from the trailing edge to the trailing edge cavity for cooling a trailing edge portion of the airfoil with compensation for temperature increase of cooling gas along said trailing edge cavity.

2. The element of claim 1 wherein the trailing edge cavity is a trailing edge impingement cavity.

3. The element of claim 2 wherein a penultimate cavity ahead of the trailing edge impingement cavity is also an impingement cavity.

4. A method of manufacture of a turbine element having:

a platform; and an airfoil:

extending along a length from a proximal root at the platform to a distal end;

having leading and trailing edges separating pressure and suction sides; and having a cooling passageway network including at least one trailing edge impingement cavity and a plurality of trailing edge holes extending from the trailing edge to the trailing edge impingement cavity, the method comprising:

casting a turbine element precursor;

simultaneously machining a first group of said plurality of said holes; and simultaneously machining a second group of said plurality of holes outboard of said first plurality of holes and having a characteristic spacing differing from a characteristic spacing from the first group.

5. The method of claim 4 wherein centerlines of said first group of holes are non-parallel to centerlines of said second group of holes.

6. The method of claim 4 wherein the machining of the first group is preformed using a first apparatus and the machining of the second group is preformed using a second apparatus and the method further comprises simultaneously machining a third group of said trailing edge holes using said first apparatus.

7. A turbine element comprising:

an airfoil having:

first and second ends;

leading and trailing edges; and an internal cooling passageway network including at least one trailing edge cavity and a plurality of trailing edge holes extending from the trailing edge to the trailing edge cavity, wherein:

the trailing edge holes are arrayed at a spacing which progressively changes along a portion of said trailing edge from the first end toward the second end; and there are several groups of said trailing edge holes, the holes in each said group having centerlines parallel to each other, and the centerlines of holes in at least two of said groups being non-parallel to each other.

8. The element of claim 7 wherein the trailing edge cavity is a trailing edge impingement cavity.

9. The element of claim 8 wherein a penultimate cavity ahead of the trailing edge impingement cavity is also an impingement cavity.

10. A turbine blade element comprising:

an airfoil having:

a first end being a root end and a second end being a free tip;

leading and trailing edges; and an internal cooling passageway network including at least one trailing edge cavity and a plurality of trailing edge holes extending from the trailing edge to the trailing edge cavity, wherein the trailing edge holes are arrayed at a spacing which progressively changes along a portion of said trailing edge from the first end toward the second end.

11. The element of claim 10 wherein the trailing edge cavity is a trailing edge impingement cavity.

12. The element of claim 10 wherein the portion is at least 50% of a length of the trailing edge and the spacing continuously progressively decreases in the first direction.

13. A turbine element comprising:

an airfoil having:

first and second ends;

leading and trailing edges; and an internal cooling passageway network including at least one trailing edge cavity and a plurality of trailing edge holes extending from the trailing edge to the trailing edge cavity, wherein the trailing edge holes have diameters between 0.015 and 0.025 inch and are arrayed at a spacing which progressively changes along a portion of said trailing edge from the first end to the second end.

14. The element of claim 13 wherein the trailing edge cavity is a trailing edge impingement cavity.

15. The element of claim 13 wherein the portion is at least 50% of a length of the trailing edge and the spacing continuously progressively decreases in the first direction.

16. A turbine element comprising:

an airfoil having:

first and second ends;

leading and trailing edges; and an internal cooling passageway network including at least one trailing edge cavity and a plurality of trailing edge holes extending from the trailing edge to the trailing edge cavity, wherein:

the trailing edge holes are arrayed at a spacing which progressively changes along a portion of said trailing edge from the first end toward the second end;

the network is adapted to direct cooling gas within the trailing edge cavity to increase in temperature in a first direction parallel to the trailing edge; and the spacing substantially progressively decreases in the first direction.

17. The element of claim 16 being a vane and wherein the first direction is an inboard direction.

18. The element of claim 16 wherein the trailing edge holes have diameters between 0.015 and 0.025 inch.

19. The element of claim 16 wherein the trailing edge cavity is a trailing edge impingement cavity.

20. The element of claim 19 wherein a penultimate cavity ahead of the trailing edge impingement cavity is also an impingement cavity.

* * * * *